US012687091B2

(12) United States Patent
Shaw et al.

(10) Patent No.: US 12,687,091 B2
(45) Date of Patent: Jul. 21, 2026

(54) CONTINGENCY FOR SURFACE CONTROLLED GAS LIFT VALVE

(71) Applicant: Silverwell Technology Limited, Girton (GB)

(72) Inventors: Joel David Shaw, Houston, TX (US); Rafael Bastardo, Dubai (AE)

(73) Assignee: Silverwell Technology Limited, Girton (GB)

( * ) Notice: Subject to any disclaimer, the term of this patent is extended or adjusted under 35 U.S.C. 154(b) by 0 days.

(21) Appl. No.: 18/664,087

(22) Filed: May 14, 2024

(65) Prior Publication Data

US 2025/0354465 A1 Nov. 20, 2025

(51) Int. Cl.

| | |
|---|---|
| ***E21B 43/12*** | (2006.01) |
| ***E21B 34/06*** | (2006.01) |
| ***E21B 34/08*** | (2006.01) |
| ***E21B 43/26*** | (2006.01) |

(52) U.S. Cl.

CPC ..... *E21B 43/123* (2013.01); *E21B 34/066* (2013.01); *E21B 34/08* (2013.01); *E21B 43/2605* (2020.05)

(58) Field of Classification Search

CPC .. E21B 43/123; E21B 43/2605; E21B 34/066; E21B 34/08

See application file for complete search history.

(56) References Cited

U.S. PATENT DOCUMENTS

| | | | | |
|---|---|---|---|---|
| 2,204,817 | A * | 6/1940 | Nixon | E21B 43/123 251/339 |
| 3,011,511 | A | 12/1961 | Canalizo | |
| 3,059,700 | A | 10/1962 | Loy, III et al. | |
| 4,295,796 | A | 10/1981 | Moore | |
| 5,535,767 | A | 7/1996 | Schnatzmeyer et al. | |
| 7,228,909 | B2 | 6/2007 | Schmidt et al. | |
| 7,658,229 | B2 | 2/2010 | Becker et al. | |
| 9,605,521 | B2 | 3/2017 | Salihbegovic | |

(Continued)

FOREIGN PATENT DOCUMENTS

| | | |
|---|---|---|
| CN | 102791956 B | 5/2015 |
| CN | 113090231 B | 9/2022 |

(Continued)

OTHER PUBLICATIONS

International Search Report & Written Opinion issued in International Application No. PCT/EP2025/063095; report mail date Jul. 17, 2025; pp. 1-13.

(Continued)

*Primary Examiner* — Tara Schimpf

*Assistant Examiner* — Jennifer A Railey

(74) *Attorney, Agent, or Firm* — Bracewell LLP; Keith R. Derrington

(57) ABSTRACT

A contingency for non-operation of a valve in a side pocket mandrel of production tubing includes creating a selective barrier to fluid communication across sidewalls of the production tubing. The barrier is formed by an insert that is installed in the side pocket mandrel, which includes a valve that responds to pressures inside and outside the production tubing to selectively allow fluid flow across the production tubing sidewalls. Types of the valve include a surface controlled gas lift valve, an inflow control valve, and an inflow control device.

13 Claims, 14 Drawing Sheets

(56) References Cited

U.S. PATENT DOCUMENTS

| | | | |
|---|---|---|---|
| 10,787,889 | B2 | 9/2020 | Salihbegovic et al. |
| 10,830,003 | B2 | 11/2020 | Romer et al. |
| 2006/0237191 | A1 | 10/2006 | Yeo et al. |
| 2013/0220599 | A1 | 8/2013 | Rae |
| 2021/0131238 | A1* | 5/2021 | Stojkovic ..... E21B 34/08 |
| 2023/0049394 | A1 | 2/2023 | Rashid et al. |
| 2024/0133276 | A1 | 4/2024 | Brown et al. |
| 2024/0352836 | A1 | 10/2024 | Brown |

FOREIGN PATENT DOCUMENTS

| | | | |
|---|---|---|---|
| EP | 1686235 | A1 | 8/2006 |
| WO | 2024043786 | A1 | 2/2024 |

OTHER PUBLICATIONS

International Search Report & Written Opinion issued in International Application No. PCT/GB2025/052213; report mail date Jan. 14, 2026; pp. 1-19.

* cited by examiner

CONTINGENCY FOR SURFACE CONTROLLED GAS LIFT VALVE

BACKGROUND OF THE INVENTION

1. Field of Invention

The present disclosure relates to contingent operation of a surface controlled gas lift valve.

2. Description of Prior Art

A gas lift system is a type of artificial lift sometimes used for assisting with the production of liquid from inside a wellbore. When the liquid being lifted is in production tubing installed in the wellbore, the lift gas is usually directed into an annulus between the production tubing and sidewalls of the well, and then routed into the production tubing through a gas lift valve. Conversely, when the liquid is in the annulus, the lift gas is injected into the tubing, and through the gas lift valve into the annulus. Gas lift is commonly employed when pressure in a formation surrounding the well is insufficient to urge fluids to surface that are inside of the production tubing. By injecting sufficient lift gas into the production tubing, static head pressure of fluid inside the production tubing is reduced to below the pressure in the formation, so that the formation pressure is sufficient to push the fluids inside the production tubing to surface. Fluids that are usually in the production tubing are hydrocarbon liquids and gases produced from the surrounding formation.

The lift gas is typically transported to the well through a piping circuit on surface that connects a source of the lift gas to a wellhead assembly mounted over the well. Usually, valves are mounted on the production tubing for regulating the flow of lift gas into the production tubing from the annulus. Some types of these valves automatically open and close in response to designated pressures in the annulus and/or tubing, while other valve types are motor operated and controlled by signals delivered from surface or another remote location. Gas lift valves are usually mounted to production tubing, so that corrective action to address a gas lift valve malfunction often requires removal of the production tubing, which is costly and time consuming.

SUMMARY OF THE INVENTION

An example method of wellbore operations is disclosed that includes monitoring a surface controlled valve that controls a flow of fluid through a sidewall of production tubing disposed in a subterranean wellbore, and when the surface controlled valve is in a non-operational state, providing a contingency flow of the fluid through the sidewall of the production tubing. An example of providing a contingency flow of the fluid through the sidewall of the production tubing includes installing a contingency insert inside the production tubing, which optionally includes a pressure controlled valve, and further optionally includes forming a contingency port through the sidewall of the production tubing, where the contingency port registers with an inlet port in the pressure controlled valve. In an alternative to this example, opposing ends of a semi-circular skirt are attached to an inner surface of the production tubing to define a cylinder, the method further comprising installing the contingency insert into the cylinder, and wherein an exit port in the pressure controlled valve registers with a side port formed radially through the skirt. Fluid inside of the cylinder is optionally vented through passages in the insert during the step of installation. In an example, an exit of the surface controlled valve attaches to a side pocket mandrel formed on the production tubing. In an alternative, the pressure control valve is an injection pressure operated valve, which optionally allows a flow of lift gas into the annulus or into the production tubing, and opens and closes in response to a destination pressure. The pressure control valve is in one example a production pressure operated valve, and the method optionally includes injecting lift gas into the production tubing to a designated pressure that opens the production pressure operated valve so that lift gas flows from inside of the production tubing to an annulus that circumscribes the production tubing. In alternatives, the method includes identifying an operational state of the surface controlled valve.

Also disclosed is an example of a system for operating a wellbore, which includes production tubing disposed in a wellbore, a surface controlled valve that is selectively in contact with a primary flow of fluid that passes through a sidewall of the production tubing, the surface controlled valve having an exit end that is connected to an outer surface of the production tubing, and a contingency flow system inside the production tubing that is selectively in contact with a contingency fluid flow when the surface controlled valve is in a non-operational state. The contingency flow system optionally includes a contingency insert having a pressure controlled valve, and where the contingency insert is installed in a cylinder in the production tubing which is formed by a skirt having opposing lateral ends and an axial end attached to an inner surface of the production tubing. Examples of the pressure controlled valve include a check valve, an injection pressure operated valve, and a production pressure operated valve. In alternatives, the contingency insert is selectively removeable from the production tubing. The system further optionally includes a vent passage inside the insert that selectively receives fluid in an end of the cylinder.

BRIEF DESCRIPTION OF DRAWINGS

Some of the features and benefits of the present invention having been stated, others will become apparent as the description proceeds when taken in conjunction with the accompanying drawings, in which.

Figure 1A:
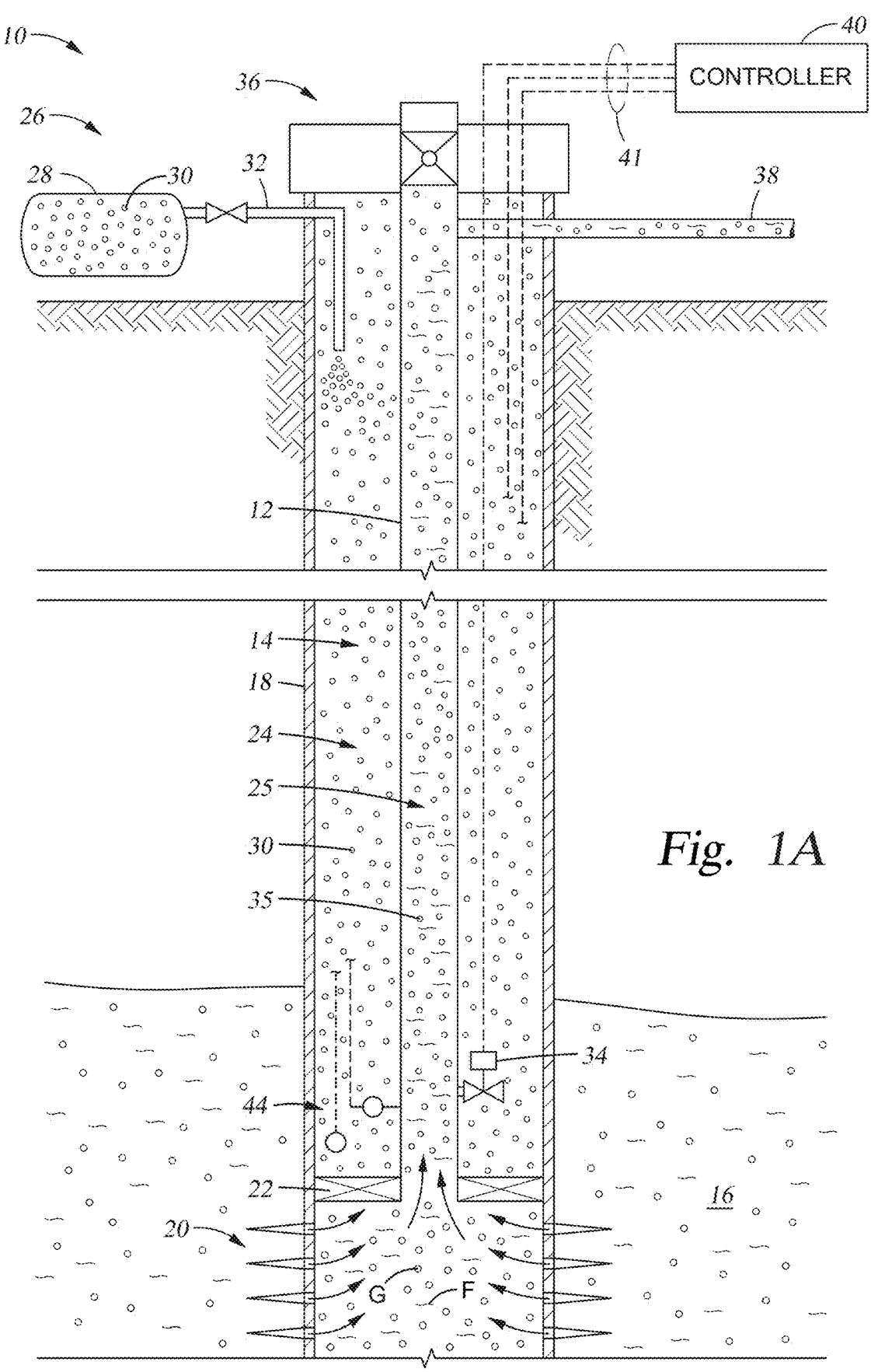
FIG. 1A is a side partial sectional view of an example of a well having a surface controlled gas lift valve.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side sectional view in FIG. 1 is an example of a well system 10, which includes a string of production tubing 12 installed within a wellbore 14 that intersects a subterranean formation 16. The wellbore 14 is lined with casing 18 that has a number of perforations 20 shown projecting radially outward from the wellbore 14 into the surrounding formation 16. In this example, the perforations 20 provide a pathway for fluid F to flow into the wellbore 14 from the formation 16. In the example shown the fluid F is made up primarily of liquid with some small bubbles of gas G mixed within. A packer 22 circumscribes a downhole end of tubing 12 to block the fluid F from flowing into an annulus 24 between the tubing 12 and casing 18, and instead directs the fluid F to a bore 25 in the production tubing 12.

The well system 10 includes a lift gas system 26 for assisting the flow of the fluid F uphole within the bore 25 of production tubing 12. An example of a lift gas source 28 is shown on the surface, embodiments of which include an adjacent well, a pipeline, or a vessel. Lift gas source 28 provides lift gas 30, which is shown being injected into the annulus 24 through an injection line 32. Lift gas 30 inside injection line 32 is at a designated pressure so that the lift gas 30 is forced downhole within annulus 24 to a surface controlled gas lift valve ("SCGLV") 34 shown mounted on an outer surface of the production tubing 12. SCGLV 34 is intermittently opened to allow the lift gas 30 into the bore 25 of production tubing 12, once in the bore 25, bubbles 35 of lift gas 30 are formed inside the fluid F. The lower density bubbles 35 reduce the density of the fluid F to assist the flow of fluid F uphole inside bore 25 and to a wellhead assembly 36 shown mounted over the wellbore 14 and connected to an end of production tubing 12. Inside wellhead assembly 36, the fluid F is directed to a production line 38 shown attached to a lateral side of wellhead assembly 36. Inside production line 38, fluid F is carried to a location that is offsite for transportation or to a processing facility (not shown). In the example of FIG. 1A, a controller 40 is schematically illustrated outside of wellbore 14 and in signal communication with the SCGLV 34 via communication means 42. Examples of communication means 42 include electrically conducting wire, fiber optics, hydraulics, and wireless, such as telemetry. Further optionally included are sensors 44 that are in temperature and pressure communication with annulus 24 and/or bore 25, and which transmit downhole conditions to controller 40 via communication means 42.

Figure 2:
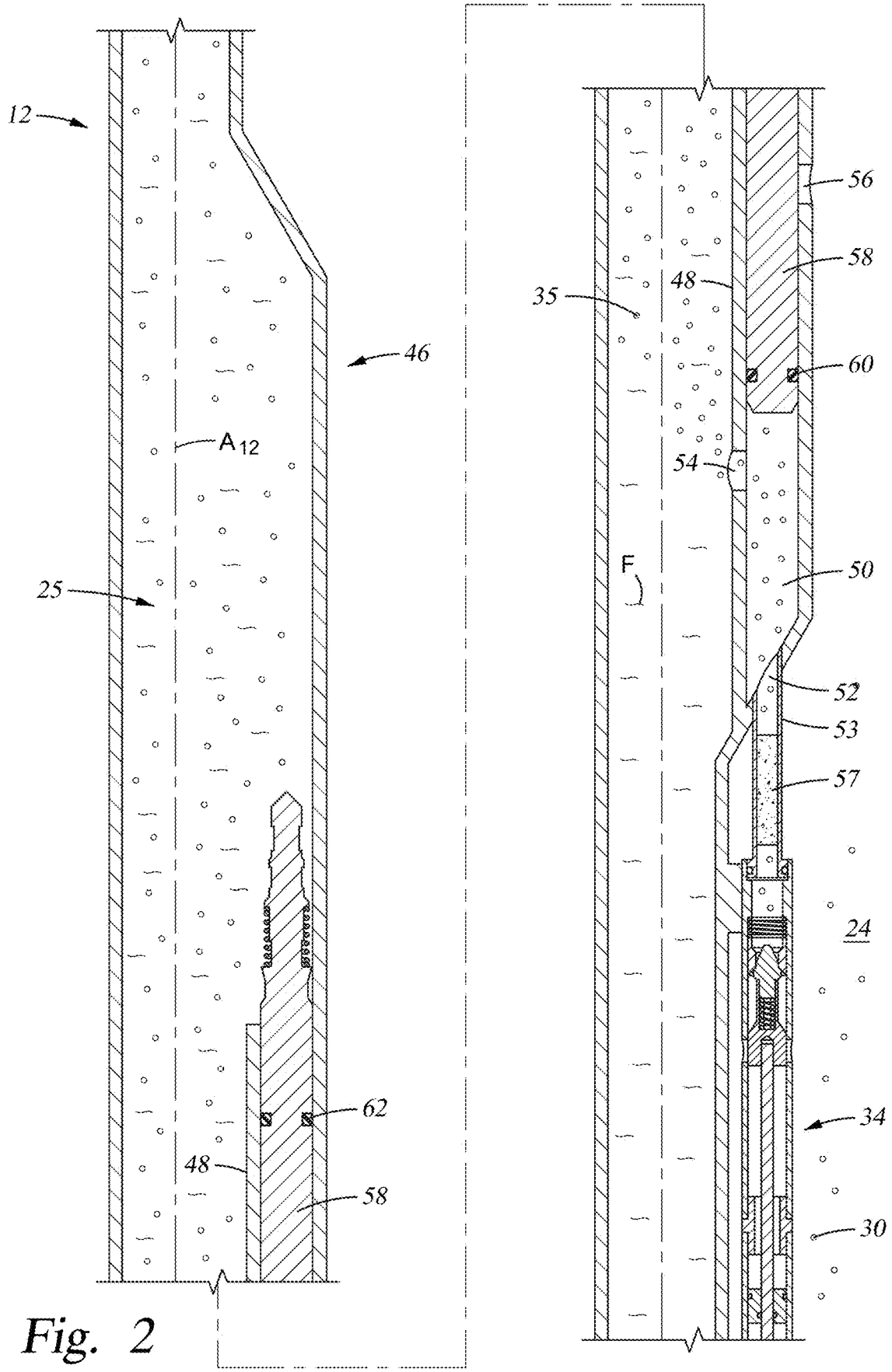
FIG. 2 is a side sectional view of an example of the surface controlled gas lift valve of FIG. 1A in a side pocket mandrel and injecting lift gas into production tubing.

Shown in a side sectional view in FIG. 2 is an example of the production tubing 12 with the SCGLV 34 connected to a side pocket mandrel 46 of the production tubing 12; which is an enlarged diameter portion of tubing 12. Axial ends of the side pocket mandrel 46 extend obliquely from an outer surface of tubing 12 and are angled towards one another. In the example shown, SCGLV 34 connects to a downhole end of the side pocket mandrel 46. Inside the side pocket mandrel 46 is a skirt 48 shown extending along a path that is generally parallel with an axis $A_{12}$ of production tubing 12, a downhole end of skirt 48 attaches to the downhole end of side pocket mandrel 46, and an uphole end of skirt 48 is proximate a mid-portion of side pocket mandrel 46. Lateral edges of skirt 48 attach to inner sidewalls of side pocket mandrel 46 at angularly spaced apart locations. A cylinder 50 is defined between skirt 48 and inner sidewalls of the side pocket mandrel 46. An inlet port 52 is formed through the downhole end of side pocket mandrel 46, a nipple 53 connects port 52 to an outlet of SCGLV 34, which provides communication between SCGLV 34 and cylinder 50. A side port 54 is formed radially through the skirt 28, and which provides a pathway of lift gas 30 within the cylinder 50 to flow into the bore 25.

In the side pocket mandrel 46 of FIG. 2, a contingency port 56 is formed radially through an outer side wall of side pocket mandrel 46, which as described in more detail below, provides an inlet for a contingency flow of lift gas 30 when and if the SCGLV 34 is a non-operational state. An example of the SCGLV 34 being in a non-operational state is that the SCGLV 34 is remains in a fully open/closed or partially open/closed configuration, and is not responsive to command signals, such as from surface via communication means 42. Another example of a non-operational state of SCGLV 34 is a blockage 57 in port 52 or nipple 53 that forms a barrier to fluid flow therethrough. In a non-limiting example of operation during which SCGLV 34 is in an operational state, communication from annulus 24 to inside of cylinder 50 through the port 56 is blocked by an insert 58 shown installed within the cylinder 50. An example of SCGLV 34 being in an operational state, is that the SCGLV 34 is selectively opened and closed in response to command signals from surface transmitted via communication means 42 (FIG. 1A) to inject lift gas 30 into bore 25. In the example of FIG. 2, insert 58 is elongated and substantially solid. O-ring seals 60, 62 are shown circumscribing the insert 58 at spaced apart locations, and which respectively form barriers to fluid flow from contingency port 56 to side port 54 and an opening of cylinder 50.

Figure 3:
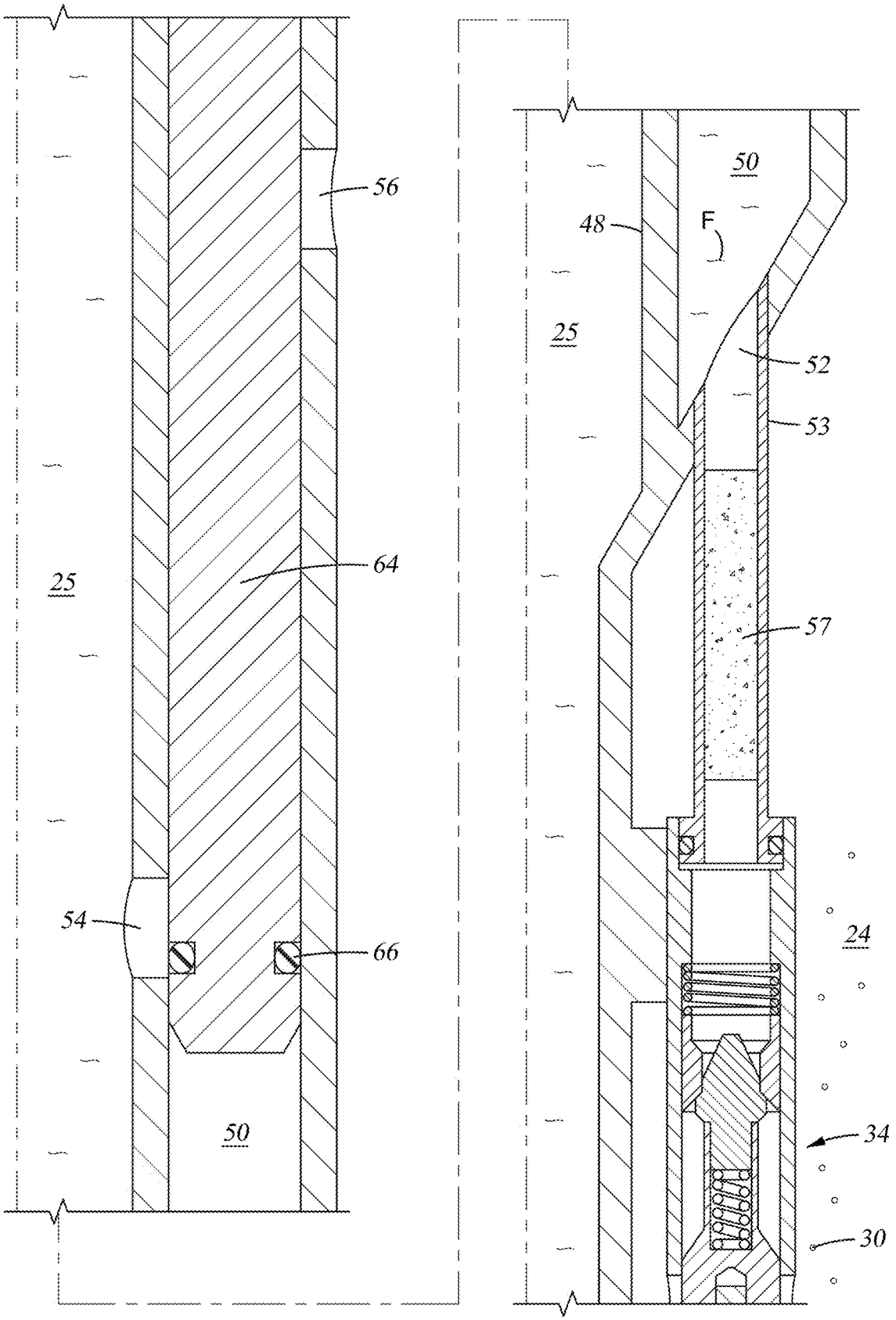
FIG. 3 is a side sectional view of an example of the surface controlled gas lift valve of FIG. 2 out of service.

Shown in a side sectional view in FIG. 3 is an example in which the SCGLV 34 of FIG. 2 is in a non-operational state, and a blind insert 64 is disposed in cylinder 50 in an example attempt to block lift gas 30 in the annulus 24 from reaching the bore 25 through the SCGLV 34 or ports 54, 56 in the side pocket mandrel 46. In this example, the blind insert 64 is inserted into the cylinder 50 after the insert 58 (FIG. 2) has been removed from within cylinder 50. A problem encountered is that the presence of fluid F, which is not fully compressible, remains within cylinder 50 and so that blind insert 64 is prevented from being inserted within cylinder 50 to a location such that an O-ring seal 66 circumscribing insert 64 remains adjacent side port 54, and cannot isolate inlet 54 from SCGLV 34.

Figure 4A:
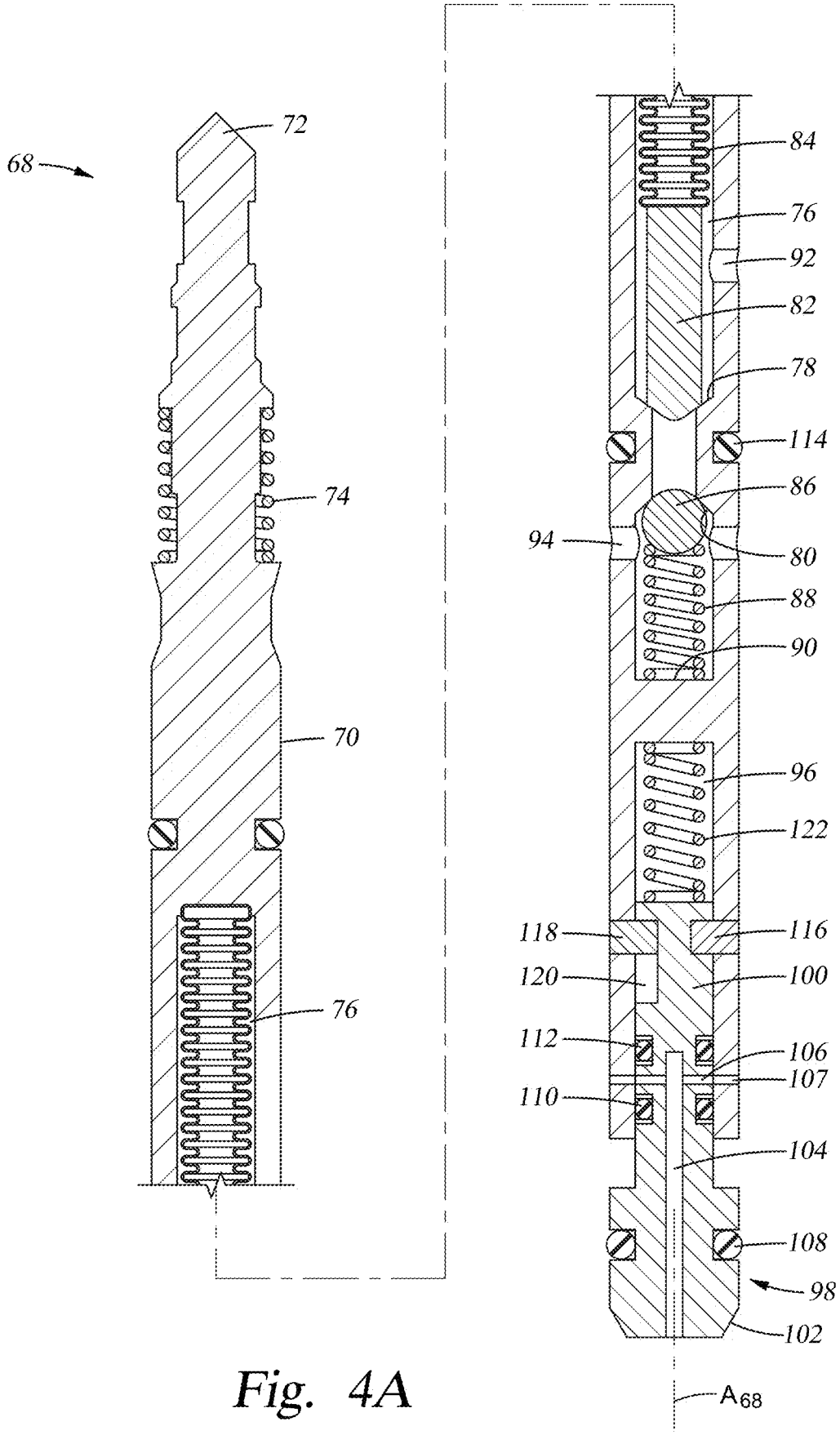
FIG. 4A is a side sectional view of an example of a contingency insert for use when the surface controlled gas lift valve of FIG. 2 is out of service.

Shown in a side sectional view in FIG. 4A is an example of a contingency insert 68 equipped to compensate for the incompressible fluid problem illustrated in FIG. 3. Contingency insert 68 includes a body 70 having an uphole end 72 profiled similar to what is commonly known as a fishing neck. Adjacent the uphole end 72 is a recess along an outer surface of body 70 and in which a spring 74 is installed, spring 74 is part of a latching mechanism for retrieving the insert 68. A chamber 76 is formed within a mid-portion of body 70, chamber 76 has an outer diameter that transitions radially inward to form an uphole-facing shoulder 78, the outer diameter transitions radially outward a distance away from shoulder 78 to form a downhole-facing shoulder 80. A valve member 82 is shown in chamber 76 having a downhole end that is rounded and in contact with shoulder 78, an uphole end of valve member 82 is generally planar and shown attached to a downhole end of bellows 84. An uphole end of bellows 84 is mounted to an uphole end of chamber 76. Another valve member 86 is inside chamber 76 shown abutting shoulder 80. Valve member 86 is shown as a generally spherical member and biased against shoulder 80 by a spring 88, an end of spring 88 opposite valve member 86 abuts an end wall 90, which defines a downhole end of chamber 76. In the example shown, chamber 76 is isolated from the surrounding environment by the bellows 84. An inlet port 92 is formed radially into the body 70, which extends into chamber 76 and adjacent a lateral surface of valve member 82. An exit port 94 extends radially into body 70 and intersects chamber 76 at a location adjacent valve member 86. The combination of the valve members 82, 86, ports 92, 94, chamber 76, and bellows 84 is configured to operate substantially the same as an injection pressure operated ("IPO") valve. An example of an IPO valve is found in Shaw, U.S. Pat. No. 11,441,401, which is assigned to the assignee of the present application and incorporated by reference herein in its entirety and for all purposes. A receptacle 96 is shown formed into an end of body 70 opposite from uphole end 72, in the example shown receptacle 96 is a generally cylindrical void having an uphole end that is spaced away location downhole of end wall 90. A bleed plug 98 is shown having a shaft 100 that inserts into the receptacle 96. Bleed plug 98 includes a nose portion 102 shown with an outer diameter exceeding shaft 100, nose portion 102 attaches to an end of shaft 100 outside of receptacle 96. A passage 104 extends axially through the bleed plug 98 and along a path substantially parallel with axis $A_{68}$ of insert 68. Inside shaft 100 are ducts 106 that project radially outward from passage 104, in the example of FIG. 4A ducts 106 are registered with bleed ports 107 that extend radially from the receptacle 96 to an outer surface of body 70. An O-ring 108 circumscribes an outer surface of the nose portion 102, and O-rings 110, 112 circumscribe shaft 100 on opposing sides of the ducts 106. O-rings 114 are also shown circumscribing body 70 at an axial location between shoulders 78, 80.

Figure 4B:
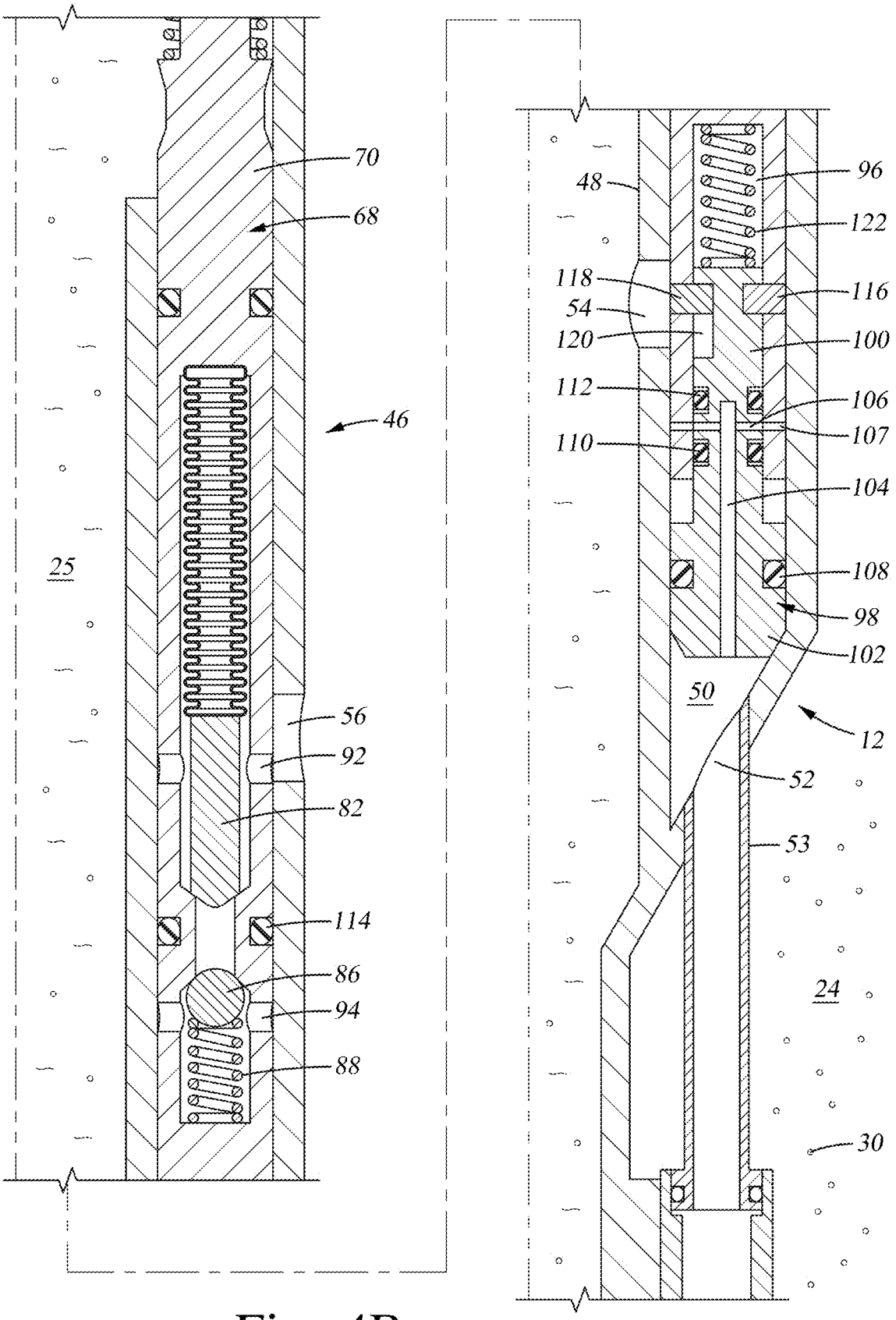
FIGS. 4B-4D are side sectional views of an example of installing the contingency insert of FIG. 4A into the side pocket mandrel of FIG. 2.
Figure 4C:
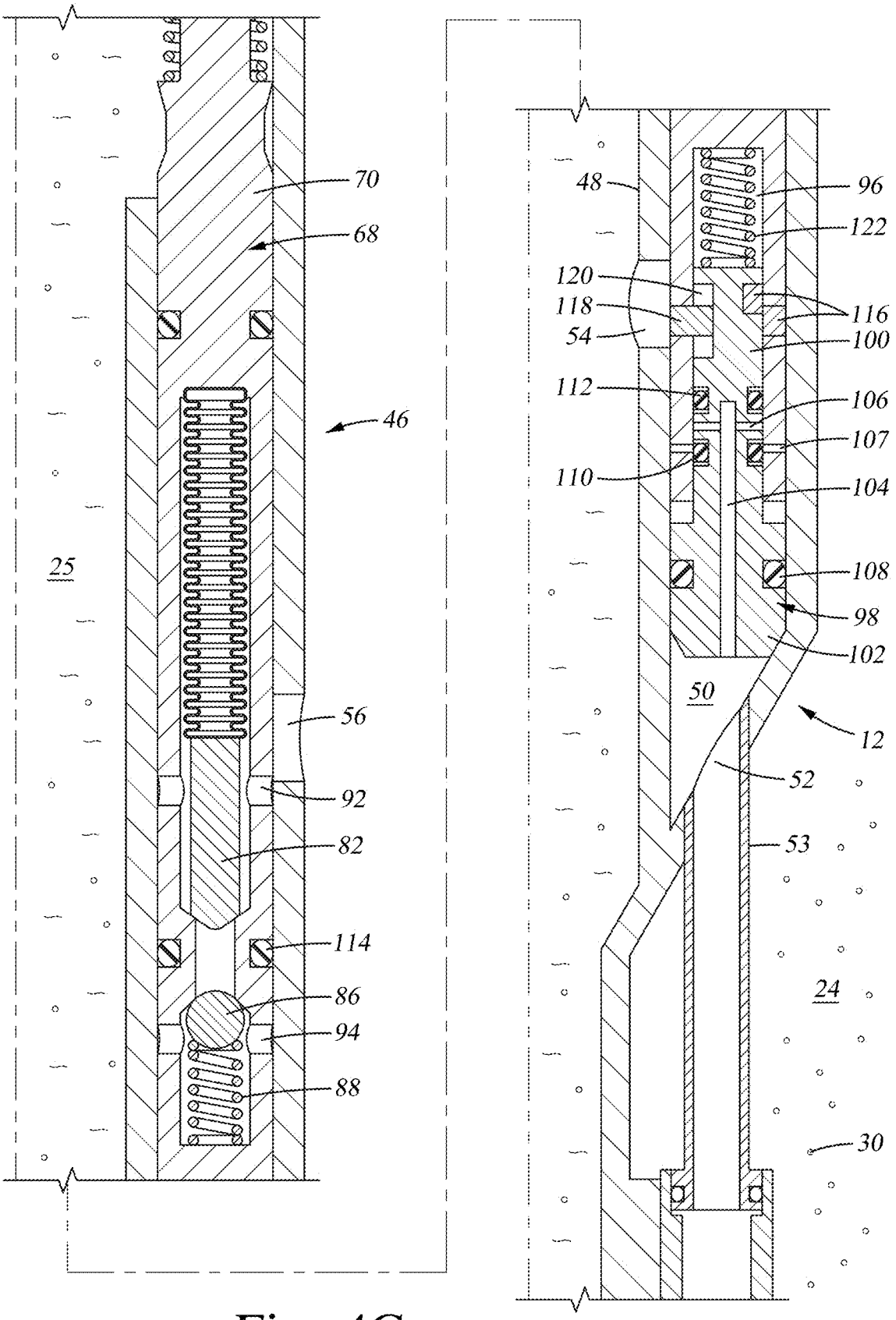

Shown in FIGS. 4B and 4C is insertion of the contingency insert 68 into the cylinder 50 and how the fluid within cylinder 50 is vented through the bleed plug 98, which allows for insertion of the contingency insert 68 to a designated location within the cylinder 50. More specifically, in FIG. 4B the nose plug 98 is shown having been inserted to a bottom portion of cylinder 50, and the fluid pooled in the bottom portion of cylinder 50 being ported into the passage 104 and exiting into the bleed port 107 via the ducts 106, and where it escapes from the cylinder 50 through the side port 54. Referring back to FIG. 4A, shown is a shear pin 116 that extends radially through shaft 100 and body 70, and which retains shaft 100 in a fixed location and so that ducts 106 and port 107 remain in registration with one another. A retaining pin 118 projects radially through the side wall of body 70 and into a recess 120 that extends axially along an outer surface of shaft 100. The retaining pin 118 limits axial reciprocating motion of shaft 100 within the receptacle 96.

Figure 4D:
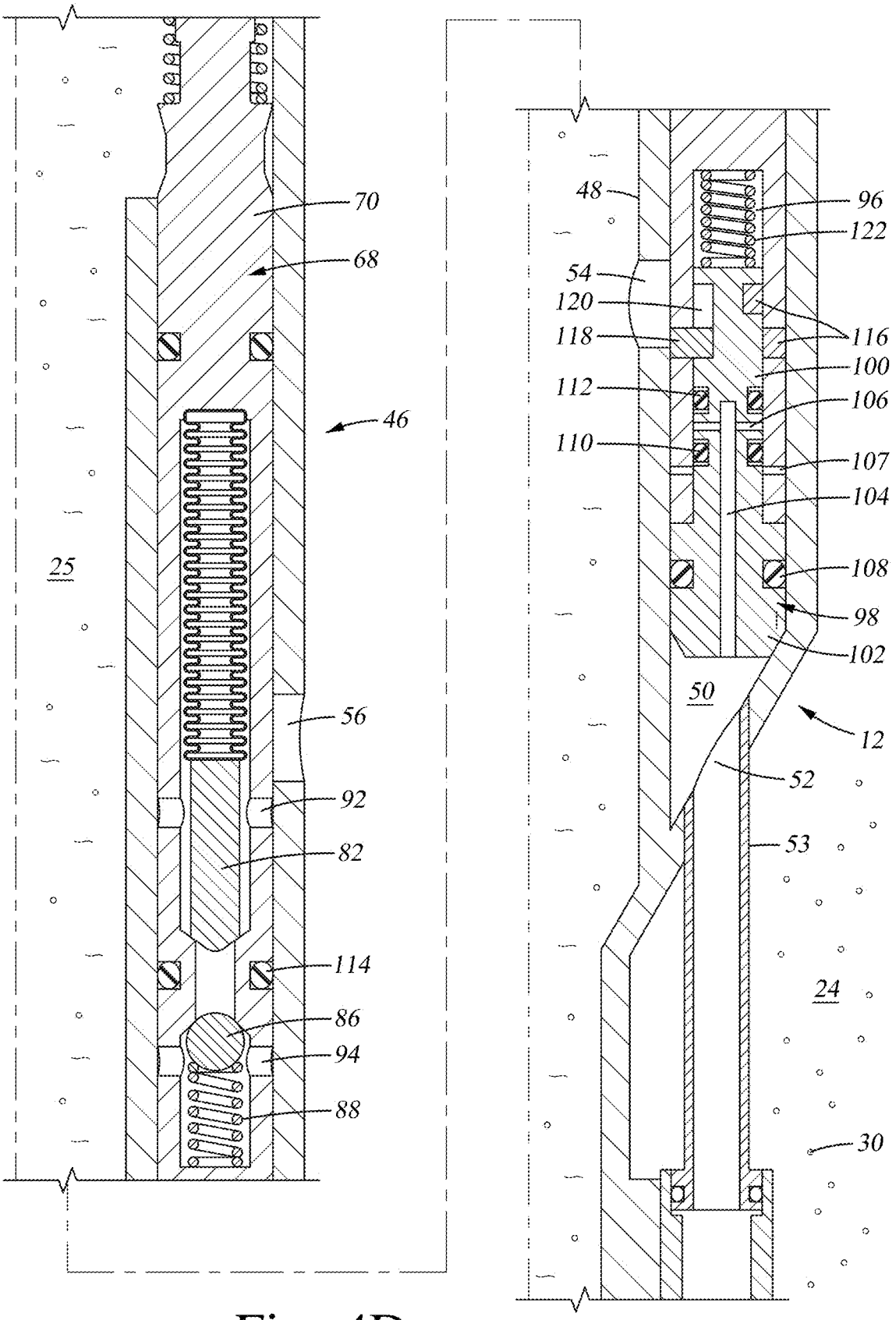
Figure 4E:
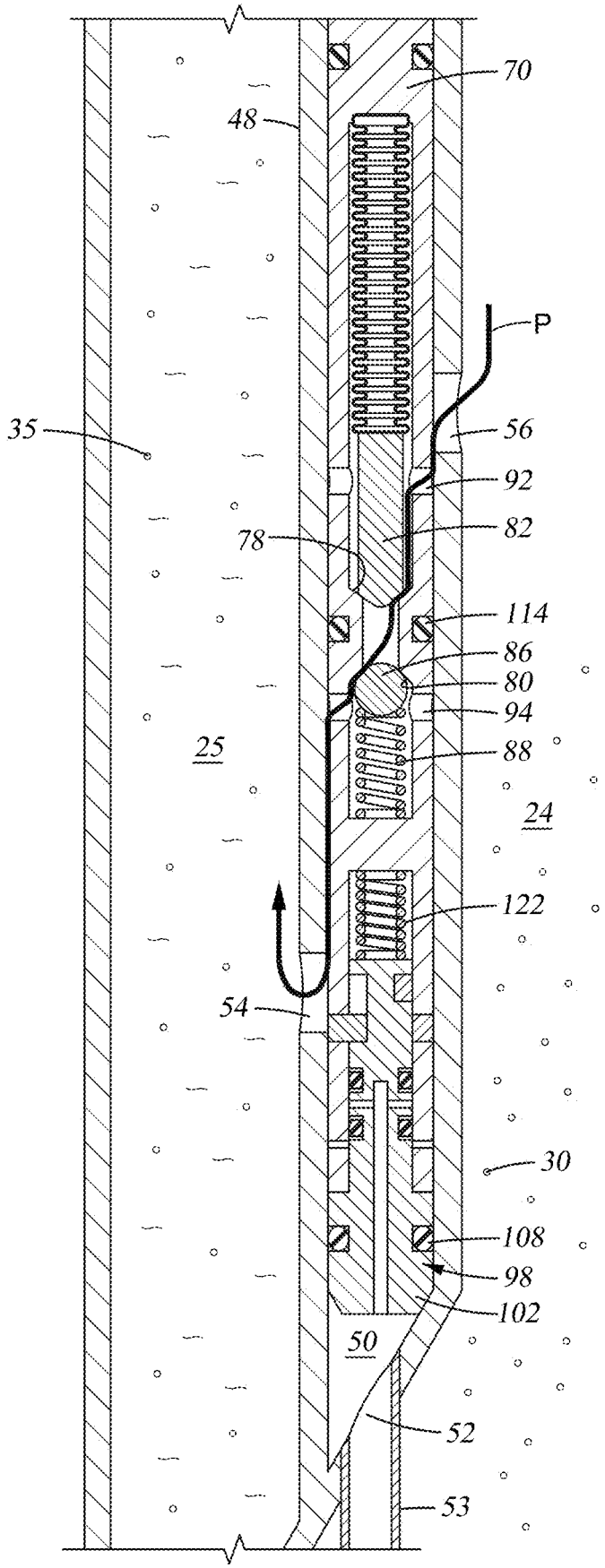
FIG. 4E is a side sectional view of an example of operation of the contingency insert of FIG. 4A.

Referring now to FIG. 4C, further axial urging of the insert 68 into the cylinder 50 fractures shear pin 116 allowing relative movement between the bleed plug 98 and body 70, which moves the port 106 and duct 107 out of registration with one another. As illustrated in FIG. 4D, continued axial urging of the insert 68 into the cylinder 50 urges bleed plug 98 deeper into receptacle 96 and further compressing a spring 122 shown within receptacle 96 and abutting an end of shaft 100 opposite the nose portion 102. The combination of the O-ring seals 108, 114, 110 and 112 and the non-registration of ports and ducts 106, 107 block fluid communication between port 52 and bore 25. Though a path P for lift gas 30 within annulus 24 to be selectively injected into bore 25 is shown in FIG. 4E. In the example of FIG. 4E, the contingency insert 68 operates as an IPO valve, and the lift gas 30 within annulus 24 enters port 56 due to a pressure differential between annulus 24 and bore 25. The path P extends through port 56, across the interfaces between valve elements 82, 86 and shoulders 78, 80, between body 70 and skirt 48, and through port 54 into bore 25. In an alternate embodiment, contingency insert operates as a production pressure valve and responsive to pressure inside the bore 25.

Figure 5A:
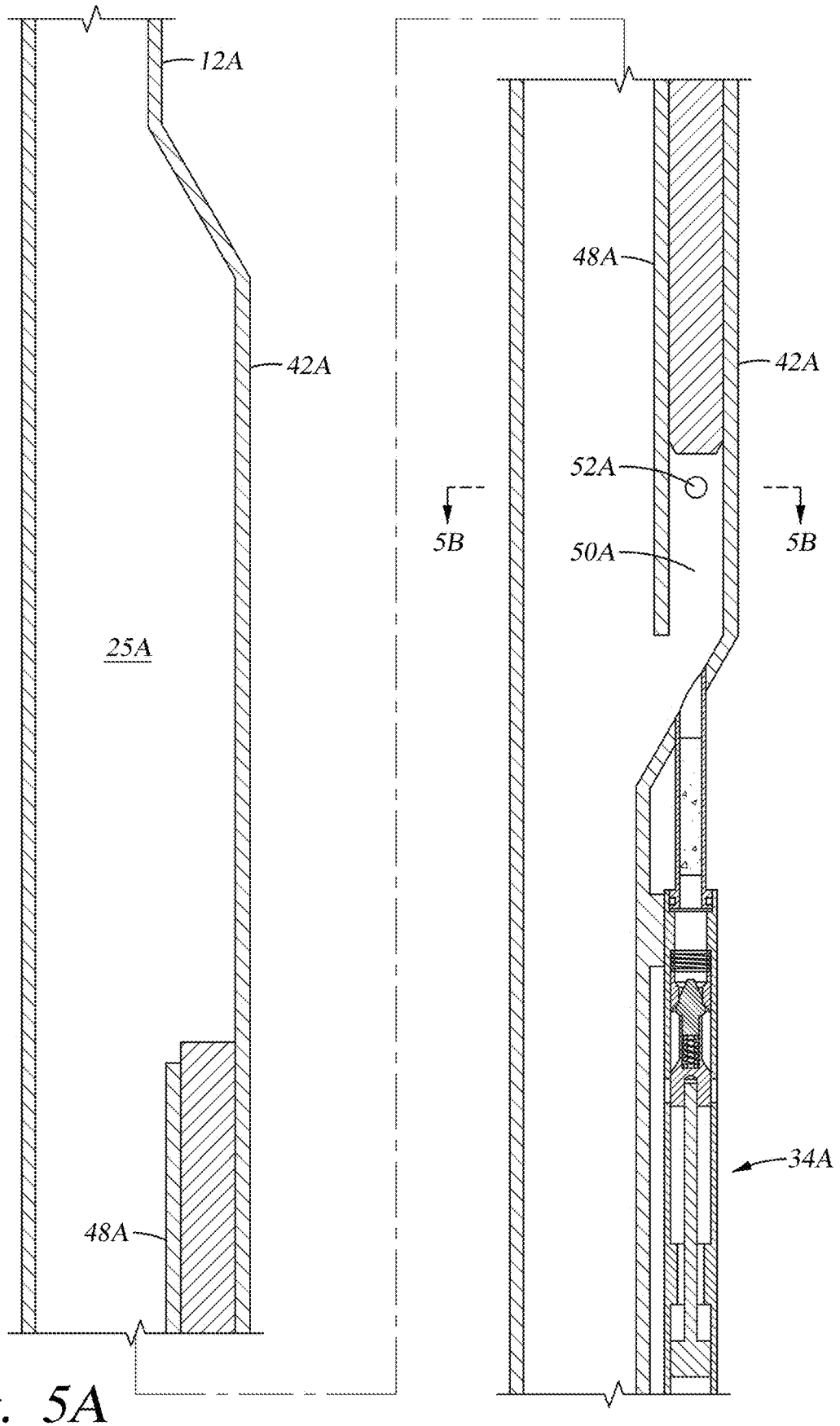
FIG. 5A is an elevational sectional view of the surface controlled gas lift valve installed in an alternate embodiment of a side pocket mandrel.
Figure 5B:
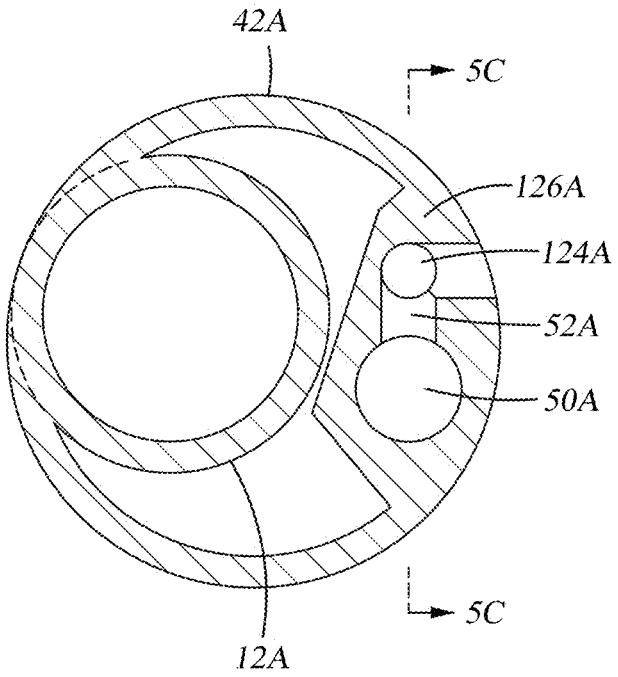
FIG. 5B is an axial sectional view of the side pocket mandrel of FIG. 5A and taken along lines 5B-5B.
Figure 5C:
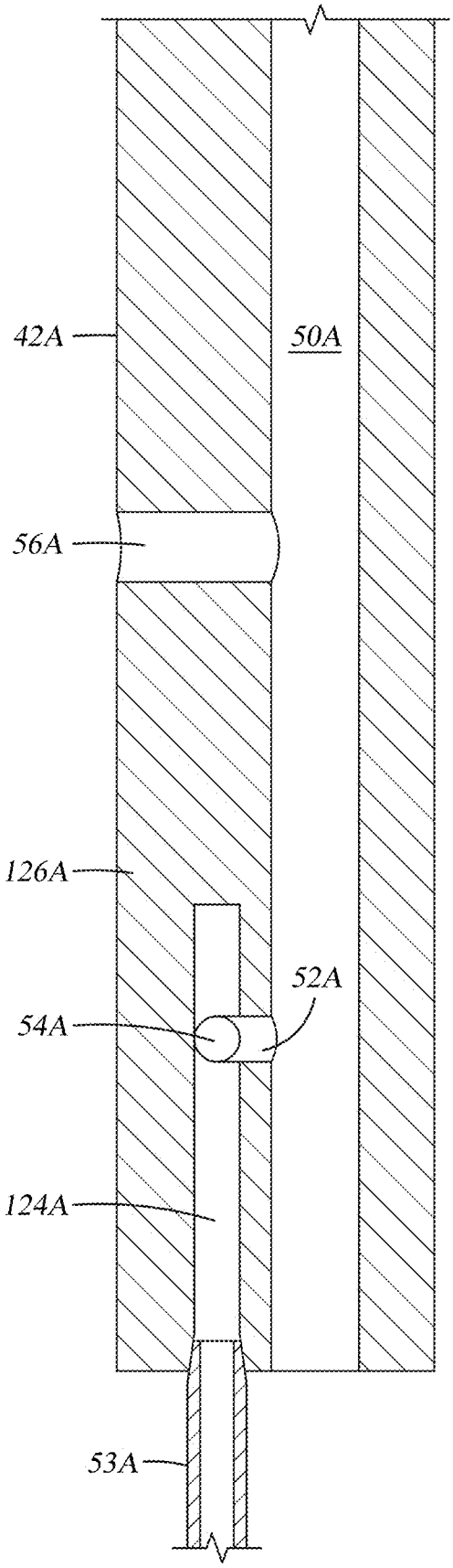
FIG. 5C is an elevational sectional view of a portion of the side pocket mandrel of FIG. 5B and taken along lines 5C-5C.

Shown in FIGS. 5A through 5C is an alternate example of a side pocket mandrel 42A formed on a portion of production tubing 12A. In this example, the inlet port 52A, which is in communication with the SCGLV 34A, is formed through a side wall of the side pocket mandrel 42A and spaced away from its downhole end. Further, the skirt 48A is also spaced away from the downhole end of the side pocket mandrel 42A, and so that fluid cannot collect to hinder full insertion of an insert into cylinder 50A as discussed above in FIG. 3. Shown in an axial sectional view in FIG. 5B, and taken along the lines 5B-5B of FIG. 5A, is that the side pocket mandrel 42A includes a lead port 124A (which similar to the inlet port 52 of FIG. 2) that provides an inlet for lift gas from the SCGLV 34A to make its way into the bore 25A of production tubing 12A. Lead port 124A extends generally axially within a manifold 126A formed in the side pocket mandrel 42A. And shown in FIG. 5C, which is taken along lines 5C-5C of FIG. 5B, is that inlet port 52 provides communication from lead port 124A and into cylinder 50A, where lift gas is communicated through cylinder 50A into the bore 25A of production tubing 12A.

Figure 5D:
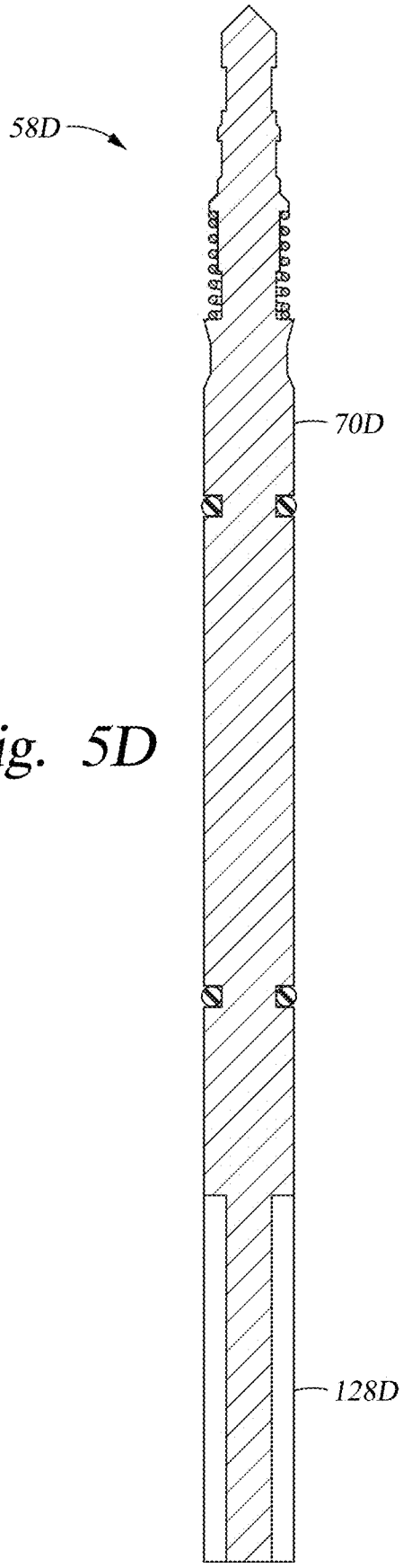
FIGS. 5D-5G are side sectional views of example embodiments of inserts for use in the side pocket mandrel of FIG. 5A.
Figure 5E:
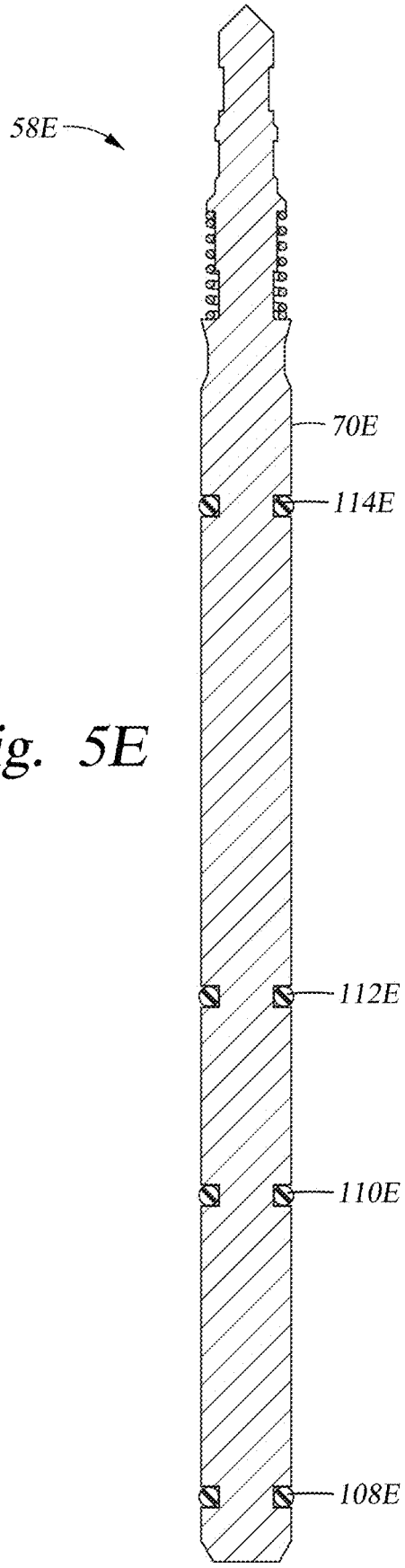
Figure 5F:
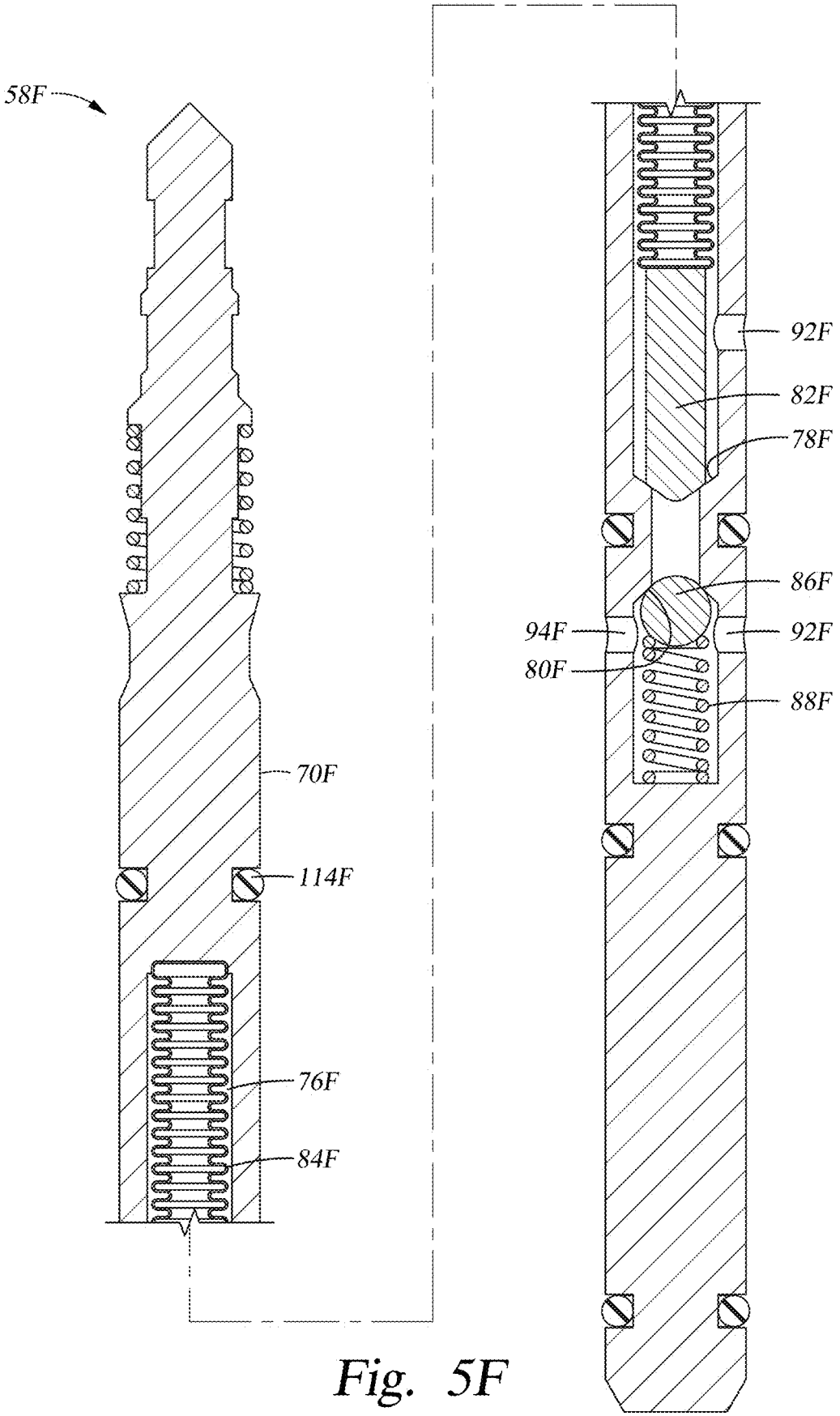
Figure 5G:
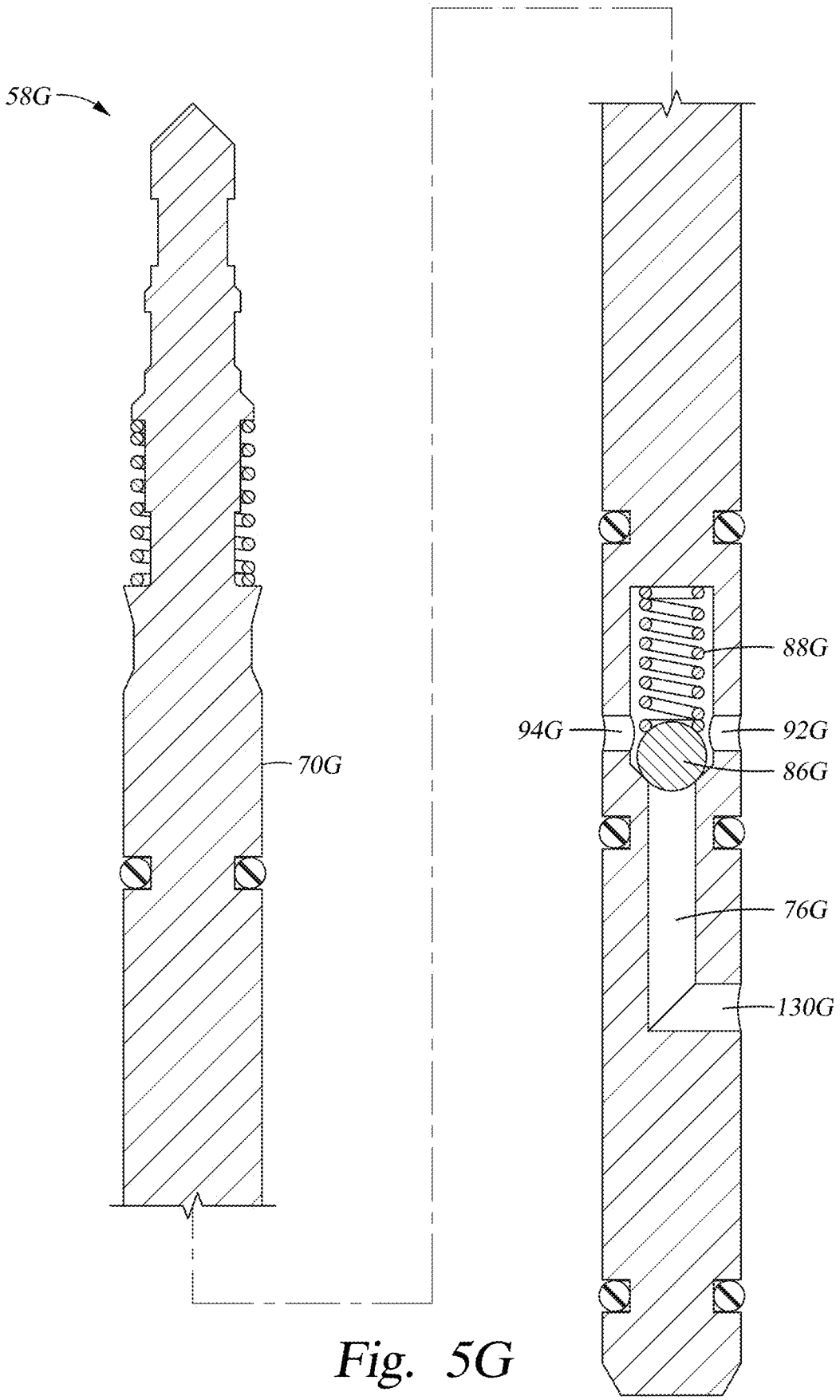

In FIGS. 5D-5G are alternate examples of inserts for installation in cylinder 50A of FIGS. 5A-5C. In the example of FIG. 5D an outer sleeve 128D is provided on a downhole end of the insert 58D, which in alternatives is formed from a material that will not degrade, or degrade to a lesser degree when particles or other abrasive material is suspended within the lift gas. In FIG. 5E is another embodiment of an insert 58E which is dimensioned to fit within cylinder 50A and having strategically located O-ring seals on its outer surface to provide selective isolation to prevent any leakage or flow that may occur through a SCGLV 34A being in a non-operational state. Shown in a side sectional view in FIG. 5F is an alternate embodiment of an insert 58F shown having valve members 82F, 86F, shoulders 78F, 80F, chamber 76F, inlet port 92F, exit port 94F, and to provide operation similar to the IPO valve discussed above with regard to FIG. 4B and FIG. 4E. In another alternative, shown in a side sectional view in FIG. 5G, is an example of an insert 58G which includes a side port 130G formed in its body 70G that intersects chamber 76G within body 70G, within chamber 76G is a valve element 86G that in this example is largely spherical, and a spring 88G is provided to bias valve element 86G into abutting contact with shoulders 78G. The valve element 86G and spring 88G in combination with ports 92G, 94G operate similar to a check valve to allow for lift gas flow through the insert 58G.

Figure 1B:
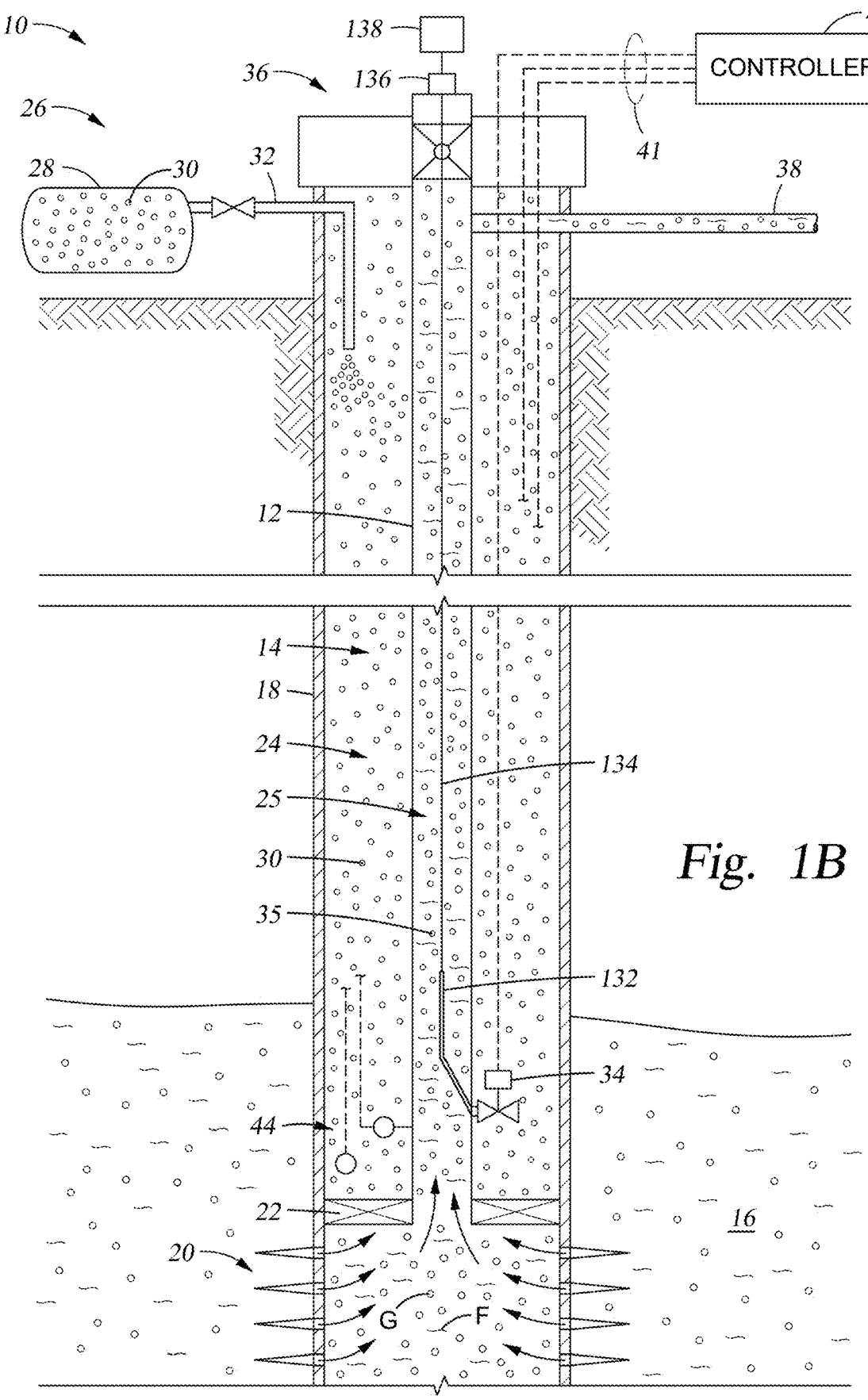
FIG. 1B is a side partial sectional view of an example of conducting a contingency operation on the surface controlled gas lift valve of FIG. 1A.

Referring now to FIG. 1B, shown is an example of operation in which the SCGLV 34 is in a non-operational state, and unable to inject lift gas 30 from the annulus 24 into the production tubing 12. In an embodiment, the non-operational state of the SCGLV 34 is detected by monitoring output signals from the sensors 44 or other sensors (not shown), or diagnostic software within controller 40. To remediate the non-operational state of the SCGLV 34, insert 58 (FIG. 2) is replaced with a contingency insert, such as contingency insert 68 of FIG. 4A. In this example, a kickover tool 132 is shown deployed within the production tubing 12 and suspended on a line 134. An optional lubricator 136 is mounted on an upper end of wellhead assembly 36, which provides pressure control for the line 134. Examples of the line 134 include wireline, slickline, coiled tubing, braided wire, and any other means for deploying a device within a well. A deployment means 138 is schematically shown attached to an end of line opposite kickover tool 132; examples of deployment means 138 include an injector, such as when dealing with coiled tubing, or a winch of when dealing with wireline or slickline. Further in the example, the kickover tool 132 is shown deployed at a depth adjacent to the side pocket mandrel 46 and for handling of the insert 58 and contingency insert 68. After installation of the contingency insert 68, lift gas 30 is selectively injected into the bore 25 by pressurizing lift gas 30 in annulus 24, which as shown in FIG. 4E, injects lift gas 30 into bore 25 and forms bubbles 35 of lift gas 30.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. Embodiments of the surface controlled flow valves include other types of flow control valves for controlling flow in a wellbore, such as inflow control valves and/or circulation valves. These and other similar modifications will readily suggest themselves to those skilled in the art, and are intended to be encompassed within the spirit of the present invention disclosed herein and the scope of the appended claims.

What is claimed is:

1. A method of wellbore operations comprising:

monitoring a surface controlled valve that controls a flow of fluid through a sidewall of production tubing disposed in a subterranean wellbore;

when the surface controlled valve is in a non-operational state and is not responsive to control signals, providing a contingency flow of the fluid through the sidewall of the production tubing by installing a contingency insert inside a cylinder in the production tubing; and forming a contingency port through the sidewall of the production tubing, and wherein the contingency insert comprises a pressure-controlled valve having an inlet port and an exit port, wherein the cylinder is defined by opposing ends of a semi-circular skirt that are attached to an inner surface of the production tubing, wherein a side port is formed radially through the skirt, and wherein when the pressure-controlled valve is installed in the cylinder, the contingency port registers with the inlet port and the exit port registers with the side port.

2. The method of claim 1, wherein fluid inside of the cylinder is vented through passages in the insert during the step of installation.

3. The method of claim 1, wherein an exit of the surface controlled valve attaches to a side pocket mandrel formed on the production tubing.

4. The method of claim 1, wherein the pressure controlled valve is selected from the group consisting of an injection pressure operated valve and a production pressure operated valve.

5. The method of claim 1, wherein the control signals are from surface.

6. The method of claim 1, further comprising identifying an operational state of the surface controlled valve.

7. A method of wellbore operations comprising:

monitoring a surface controlled valve that controls a flow of fluid through a sidewall of production tubing disposed in a subterranean wellbore;

when the surface controlled valve is in a non-operational state and is not responsive to control signals, providing a contingency flow of the fluid through the sidewall of the production tubing by installing an injection pressure operated valve inside a cylinder in the production tubing, wherein the injection pressure operated valve has an inlet port and an exit port and the cylinder is defined by opposing ends of a semi-circular skirt that are attached to an inner surface of the production tubing; and forming a contingency port through the sidewall of the production tubing; and injecting lift gas into an annulus that circumscribes the production tubing to a designated pressure that opens the injection pressure operated valve so that lift gas flows from the annulus to inside of the production tubing, and wherein a side port is formed radially through the skirt, and wherein when the injection pressure valve is installed in the cylinder, the contingency port registers with the inlet port and the exit port registers with the side port.

8. A system for operating a wellbore comprising:

production tubing disposed in a wellbore;

a surface controlled valve that is selectively in contact with a primary flow of fluid that passes through a sidewall of the production tubing, the surface controlled valve comprising an exit end that is connected to an outer surface of the production tubing;

a contingency flow system insertable inside the sidewall of the production tubing and that is selectively in contact with a contingency fluid flow that passes through the sidewall of the production tubing when the surface controlled valve is in a non-operational state;

a cylinder in the production tubing, the cylinder formed by a skirt having opposing lateral ends and an axial end attached to an inner surface of the production tubing; and a contingency insert installed in the cylinder that forms a barrier to fluid communication through the cylinder between outside and inside of the production tubing.

9. The system of claim 8, wherein the contingency insert comprises a pressure controlled valve.

10. The system of claim 9, wherein the pressure controlled valve operates by opening in response to a pressure difference, opening in response to a pressure inside an annulus around the production tubing, or opening in response to a pressure inside the production tubing.

11. The system of claim 9, further comprising a side pocket mandrel formed in the production tubing, wherein the side pocket mandrel comprises a manifold having an a first axial bore that defines the cylinder and a second axial bore that is in communication with the first axial bore and the surface controlled valve, wherein upper and lower ends of the cylinder are in communication with a bore in the production tubing, and wherein the contingency insert is selectively installed in the cylinder.

12. The system of claim 8, wherein the contingency insert is selectively removeable from the production tubing.

13. The system of claim 8, further comprising a vent passage inside the contingency insert that selectively vents fluid collected in the cylinder as the contingency insert is inserted into the cylinder.

* * * * *